US007993491B2

(12) United States Patent
Heikkilä et al.

(10) Patent No.: US 7,993,491 B2
(45) Date of Patent: Aug. 9, 2011

(54) END PART OF AN AIR DRYER, AIR DRYER, METHOD IN THE END PART OF AN AIR DRYER AND USE OF FAN

(75) Inventors: Pertti Heikkilä, Raisio (FI); Johan Lindholm, Turku (FI); Markku Laitonen, Masku (FI); Richard Solin, Kemiö (FI)

(73) Assignee: Metso Paper, Inc., Helsinki (FI)

( * ) Notice: Subject to any disclaimer, the term of this patent is extended or adjusted under 35 U.S.C. 154(b) by 144 days.

(21) Appl. No.: 12/514,783

(22) PCT Filed: Nov. 13, 2007

(86) PCT No.: PCT/FI2007/000275

§ 371 (c)(1),
(2), (4) Date: Jun. 2, 2009

(87) PCT Pub. No.: WO2008/059102

PCT Pub. Date: May 22, 2008

(65) Prior Publication Data

US 2010/0043994 A1 Feb. 25, 2010

(30) Foreign Application Priority Data

Nov. 14, 2006 (FI) ..... 20060997

(51) Int. Cl.
*D21F 5/18* (2006.01)

(52) U.S. Cl. ..... 162/207; 162/375

(58) Field of Classification Search ..... 162/207, 162/375; 34/561, 461, 422, 121
See application file for complete search history.

(56) References Cited

U.S. PATENT DOCUMENTS

| | | | | |
|---|---|---|---|---|
| 2,848,820 | A | 8/1958 | Werner et al. | |
| 4,021,931 | A | 5/1977 | Russ et al. | |
| 4,154,004 | A * | 5/1979 | Trotscher | 34/561 |
| 4,253,246 | A * | 3/1981 | Marchal | 34/121 |
| 5,471,766 | A * | 12/1995 | Heikkila et al. | 34/461 |
| 5,722,180 | A | 3/1998 | Joiner | |
| 6,092,304 | A | 7/2000 | Karlsson et al. | |
| 6,230,422 | B1 * | 5/2001 | Sairanen | 34/422 |
| 2004/0221480 | A1 | 11/2004 | Greimel et al. | |
| 2007/0130787 | A1 | 6/2007 | Möller et al. | |

FOREIGN PATENT DOCUMENTS

| | | |
|---|---|---|
| DE | 198 82 574 | 7/2000 |
| DE | 103 49 401 | 7/2004 |
| EP | 0 561 256 | 9/1993 |
| FI | 102981 | 3/1999 |
| SU | 958812 | 9/1982 |

OTHER PUBLICATIONS

English translation of claim of 1 of Patent No. SU 958812.
Decision on Grant issued in corresponding Russian Patent Application No. 2009122468.

* cited by examiner

*Primary Examiner* — Mark Halpern
(74) *Attorney, Agent, or Firm* — Cohen Pontani Lieberman & Pavane LLP

(57) ABSTRACT

The object of the invention is an end part (1) of an air dryer, the air dryer being applicable for drying a pulp web, such as a cellulose web or the like. The end part comprises a fan tower (11), and a roll tower in which a number of turn roll (27, 37) are arranged mainly on top of each other in order to turn the travelling direction of the pulp web in the air dryer, the longitudinal axis of the roll. towers being parallel, and a fan tower arranged at a distance from the roll tower, adjacent to it, comprising a number of fans arranged on top of each other, a single fan being arranged to blow heated air as drying air to a dryer group. The end part further comprises one or more centrifugal fans (14) arranged in the direct vicinity or the roll tower, and a number of end drying means (13) arranged between the roll tower and the dryer group of—the fan of the fan tower, to which end drying means drying air is supplied with said centrifugal fan or fans. A further object of the invention is also a method in the end part of an air dryer, an air dryer and use of a centrifugal fan.

23 Claims, 3 Drawing Sheets

END PART OF AN AIR DRYER, AIR DRYER, METHOD IN THE END PART OF AN AIR DRYER AND USE OF FAN

BACKGROUND OF THE INVENTION

1. Field of the Invention

The object of the invention is the end part of an air dryer, and a method in the end part of an air dryer, an air dryer and use of a centrifugal fan according to the preambles of the independent claims presented below.

2. Description of Prior Art

A typical air dryer according to prior art suitable for drying a pulp web, such as a cellulose web or the like, comprises

- an actual dryer section in which the pulp web is dried in air flotation drying with hot air jets or the like,
- at least one, usually a large number of axial circulation air fans arranged adjacent to the actual dryer section with which circulation air fans humid circulation air is discharged from the actual dryer section and with which heated circulation air is blown as drying air into the actual dryer section, and
- heating devices with which the discharged humid circulation air is heated before returning it as drying air into the actual dryer section.

Several axial fans operating side by side are usually arranged on top of each other in order to create so called fan towers, a necessary amount of which fan towers, in turn, are arranged side by side. The fans are mounted in the fan tower so that their suction openings are confined to the front and back side of the fan tower, seen from the travelling direction of the web to be dried. Heating devices are arranged on the front and back sides of the fan towers, in front of the suction openings of the fans, which heating devices heat the humid air discharged from the dryer section before the fans. A single fan of the fan tower is arranged to blow drying air to a dryer group, which consists of a number of drying means, such as nozzle boxes, extending over the web to be dried. The longitudinal direction of these drying means is thereby essentially perpendicular against the travelling direction of the web to be dried. Respectively, the drying level of the air dryer comprises a number of such adjacently arranged dryer groups.

The so-called roll towers are located in the ends of the air dryer. A number of turn rolls are arranged in the roll towers mainly on top of each other, with which turn rolls the web to be dried is turned from one drying level to the next one. At the same time the travelling direction of the web changes by 180°. The axis of the rolls are arranged parallel in the roll towers.

The area between the roll tower and the fan tower located nearest to it has proven to be problematic. Typically, due to physical size limitations, an axial fan of the size used in other fan towers of the air dryer can not be placed in said area. Due to lack of space, air intake of the fans in the fan tower located nearest to the roll tower has been problematic, sometimes even insufficient.

In the area between the roll tower and the fan tower located nearest to it, after the last dryer group, expensive auxiliary level nozzles of special structure have been arranged in order to convey the pulp web to the turn roll of the roll tower. These auxiliary level nozzles have been fed with air from the axial fans of said nearest fan tower. These axial fans have thus been used to arrange air both for the drying means of their "own" dryer groups, as well as for the auxiliary level nozzles located as an extension of the drying levels. As a consequence, the blowing capacity of the axial fans has not necessarily been sufficient to entirely satisfy the created need for blowing. Thereby the drying capacity of the dryer groups located nearest to the roll tower has decreased compared to other dryer groups of the air dryer. The amount of air fed to the auxiliary level nozzles has again not been sufficient to maintain the same blowing velocity between the roll tower and the nearest, adjacent fan tower as in the other parts of the air dryer. This has led to a generally poor drying capacity in the end parts of the air dryer. Problems have also appeared in the process if the air jets from the auxiliary level nozzles have not been able to support the pulp web to be dried, but have allowed it to "drag". This has also caused dusting problems of the web.

The end parts of the air dryers nowadays in use may have parts of even two metres long wherein the drying capacity is low due to the use of an auxiliary level nozzle. The low drying capacity leads indirectly also to an increase of the total size of the air dryers. Large air dryers occupy expensive mill room and increase the expenses of the mill investments.

SUMMARY OF THE INVENTION

It is an object of the present invention to reduce or even eliminate the above-mentioned problems appearing in the prior art.

An object of the present invention is to provide a solution by which the drying capacity of the end parts of air dryers can be improved.

Another object of the present invention is to provide a solution by which the size of an air dryer can be reduced without affecting the total drying capacity of the air dryer.

Another object of the present invention is to provide a solution by which the runnability of the end part of an air dryer can be improved.

In order to realize the above-mentioned objects, among others, the invention is characterized by what is presented in the characterizing parts of the enclosed independent claims.

The embodiments and advantages mentioned in this text are in suitable parts applicable to both an end part of an air dryer, an air dryer and a method according to the invention, even if this is not always specifically mentioned.

A typical end part of an air dryer according to the invention, the air dryer being applicable for drying a pulp web, such as a cellulose web or the like, comprises

- a roll tower in which a number of turn rolls have been arranged mainly on top of each other, the longitudinal axis of the turn rolls being parallel, in order to turn the travelling direction of the pulp web in the end part of the air dryer,
- a fan tower arranged at a distance from the roll tower, adjacent to it, comprising a number of fans arranged on top of each other, a single fan being arranged to blow heated air as drying air to a dryer group,
- one or more centrifugal fans arranged in the direct vicinity of the roll tower, and
- a number of end drying means arranged between the roll tower and the dryer group of the fan of the fan tower, to which end drying means drying air is fed with said centrifugal fan or fans.

In a typical method according to the invention in the end part of an air dryer, the air dryer being applicable for drying a pulp web, such as a cellulose web or the like,

- the travelling direction of the pulp web to be dried is turned in the end part with the aid of a turn roll arranged in a roll tower,
- heated drying air is blown towards the pulp web in order to dry it with the drying means of a dryer group, the drying air being arranged to the dryer group by a fan, which is arranged in a fan tower arranged at a distance from the roll tower, one or more centrifugal fans are arranged in the direct vicinity of the roll tower, and a number of end drying means are arranged between the roll tower and the dryer group of the fan of the fan tower, to which end drying means drying air is fed with said centrifugal fan or fans.

A typical air dryer according to the invention, applicable for drying a pulp web, such as a cellulose web or the like, comprises a number of drying levels, whereby a single drying level comprises a number of dryer groups, which comprise a number of adjacent drying means, such as nozzle boxes, in order to dry and to support the web to be dried, a number of adjacent fan towers, which comprise a number of fans arranged on top of each other, a single fan being arranged to blow heated air as drying air to one dryer group of the drying level, a number of heating devices, such as steam coils, fitted on the suction side of the fans of the fan towers in order to reheat the humid air discharged from the dryer section, a first and a second end part, which comprises a roll tower and a fan tower arranged at a distance from the roll tower, and closest to the roll tower, and the dryer groups to which the fan tower is arranged to generate drying air, the drying levels, fan towers and heating devices being arranged between the first and second end parts, and the first and/or the second end part of the air dryer is an end part according to the invention.

A centrifugal fan according to the invention is typically used, according to the invention, in an air dryer suitable for drying a pulp web, such as a cellulose web or the like, in order to supply air to the end drying means arranged between the roll tower and the dryer group of the fan tower.

It has now been surprisingly found that drying means can be arranged between the roll tower and the dryer group of the nearest fan tower arranged adjacent to the roll tower, to which drying means drying air is supplied with the aid of a centrifugal fan arranged in the direct vicinity of the roll tower. The use of a centrifugal fan enables an optimal use of the space in the end part of the air dryer without disturbing the operation of the fan towers. Addition of drying means between the dryer groups of the fan tower nearest to the roll tower and the roll tower enables a considerable increase of the drying capacity in the end part of the air dryer. As the drying capacity in the end part increases, it is possible to decrease the size of the air dryer, because with a smaller/shorter dryer it is possible to attain the same drying effect as before. Respectively, with an air dryer of the same size a considerably higher drying capacity is attained than before.

The present invention also considerably improves the usability of an air dryer and offers new possibilities for controlling the web to be dried. The invention also enables blowing of air in the end parts of an air dryer with a considerably higher velocity and capacity than before, which makes it considerably easier and simpler to control the web to be dried just before and after the turn roll. In this manner the "dragging" problems of the web caused by the low blowing velocity can be reduced and probably entirely eliminated in the area between the roll tower and the fan tower adjacent to it. At the same time the dusting caused by the "dragging" of the web is reduced, which decreases the need for cleaning and maintenance work in the air dryer. With the aid of the invention, an air dryer thus works more economically, reliably and with a more even capacity than before.

According to the invention, the air dryer can thus be a normal air dryer according to prior art with respect to other parts than the end parts. It thereby consists of a number of drying levels, which in turn comprise dryer groups formed by drying means. The pulp web, such as a cellulose web, is conveyed into the air dryer normally via its upper part the dry matter content of the web being about 45-55, typically 50% by weight. The web is supported on the drying level preferably in a non-contact manner, for example with the aid of air blows created by the drying means. The web is removed via the lower part of the air dryer, whereby its dry matter content is about 90% by weight. Typically one or two lowest air dryer levels act as cooling levels of the web to be dried. An air dryer typically has 15-30 drying levels.

Drying air is arranged to the dryer groups of the drying level by means of axial fans arranged in the fan towers one on top of the other. Each axial fan blows air to its own dryer group/groups. One axial fan can thereby blow air to several dryer groups located on adjacent drying levels.

The actual dryer section of an air dryer is typically surrounded by a protective cover, i.e. an enclosure, which comprises an upper surface, side walls and end walls. Inside the protective cover remains the actual dryer section of the air dryer and the fan towers with their fans. The rear parts of the fans of the fan towers are usually confined to the side walls of the protective cover, and for example in a maintenance situation they can be reached via maintenance platforms arranged on the side walls. The frame structures of the roll towers, such as supporting columns are typically outside the protective cover, i.e. the enclosure, of the air dryer. The turn rolls arranged on top of each other in the roll tower are arranged inside the protective cover such that the shafts of the turn rolls are arranged via shaft connections through the side walls of the protective cover in order to support the ends of the turn rolls to the frame structures, such as vertical supports, outside the protective cover. A typical roll tower typically comprises 7-15, preferably 9-11 rolls mainly arranged on top of each other, with which rolls the travelling direction of the web to be dried is turned in the end of the air dryer.

According to a very preferable embodiment of the invention, the fan towers located nearest to the roll towers are similar to all other fan towers of the air dryer. Thereby all the fan towers of the air dryer are identical with each other, also the fan towers adjacent to the roll towers. The fans of the actual fan towers are typically axial fans arranged in the side wall of the protective cover of the air dryer, which axial fans suck circulation air through heating means, such as steam coils, arranged on both sides of the axial fans, and blow the said air further to the drying means extending across the web to be dried.

Between the roll tower and the fan tower adjacent to the roll tower a fan arrangement of the end part is thereby arranged according to the invention, which arrangement comprises centrifugal fans, heating means, such as steam coils, and drying means, such as nozzle boxes.

According to a preferred embodiment of the invention the end part drying means arranged between the roll tower and the dryer group of the nearest fan tower, adjacent to the roll tower, are mainly similar to the drying means of the dryer group, preferably similar to the drying means of all dryer groups of the other fan towers of the air dryer. The drying means are preferably longitudinal nozzle boxes, which in their longitudinal direction are arranged to extend from the first side of the web to be dried to its second side. The length of a drying means is typically 3-11 m, depending on the width of the web to be dried. Typically heated air used for drying is supplied into a drying means via the end of the drying means. The drying surface of the drying means comprises nozzle slots, nozzle openings or the like, through which drying air is lead towards the web to be dried. The drying air functions at the same time also as a medium supporting the web. The height of the drying means typically diminishes beginning from the inlet end of the drying air towards the opposing end of the drying means, i.e. the drying means is thereby wedge-shaped in its longitudinal direction.

Between the roll tower and the drying means of the dryer group of the fan tower located nearest and adjacent to the roll tower, for example 3-6, preferably 4-5 drying means can be arranged. In a preferred embodiment of the invention the end drying means arranged between the roll tower and the dryer group of the adjacent fan tower are arranged in the same level with the drying means of the dryer group below the travelling path of the web to be dried. In practice, as many drying means can be arranged between the roll tower and the nearest fan tower as can be fitted in the space in question. Thereby the drying efficiency of the end part of the air dryer and the control of the web to be dried can be improved as efficiently as possible near the turn rolls.

It is also possible to arrange drying means above the travelling path of the web to be dried, between the roll tower and the nearest fan tower adjacent to the roll tower. Typically for example 2-5 such upper drying means can be arranged between the roll tower and the nearest fan tower. The upper drying means used can have a similar structure as the drying means arranged below the travelling path of the web, equipped, however, with a hole pattern of the nozzle surface designed for overhead blowing. They can be arranged so as to be lifted with the aid of turning means in order to facilitate the maintenance and cleaning of the air dryer. The drying taking place between the roll towers and the nearest fan tower of the air dryer, as well as the control of the web to be dried can be further intensified with the upper drying means.

According to the invention a centrifugal fan is arranged in the direct vicinity of the roll tower. This means that the centrifugal fan is typically arranged in the end wall of the protective cover of the air dryer in such a manner, that the motor of the centrifugal fan remains outside the protective cover and the impeller of the fan remains inside. The centrifugal fan is preferably arranged in average at a distance of 0.1-2, typically 0.1-1.5, sometimes even 0.3-0.5 meters from the nearest structure, such as for example the vertical supports, of the roll tower. The axis of the centrifugal fan preferably forms a right or almost right angle compared to the axis of the turn rolls of the roll tower. In a preferred embodiment, the axis of the centrifugal fan is arranged mainly according to the travelling direction of the web, and its blowing is arranged mainly perpendicularly as seen in the travelling direction of the web.

Any centrifugal fan at all suitable for the purpose can be used in an air dryer end part according to the invention. The centrifugal fan comprises a power source, such as a motor, and an impeller rotating around the axis. Air intake takes place in front of the impeller, i.e. the suction side of the centrifugal fan is placed, in the solution according to the invention, on the side of the web according to the travelling direction of the web. The centrifugal fan is preferably a so-called "plug fan"-type, and it is preferably mounted in the end wall of the air dryer. The centrifugal fan is typically uncovered, i.e. it is arranged to work without a spiral casing, i.e. the blown air thereby discharges from the impeller freely into the surroundings. The centrifugal fan can have a direct-drive, whereby the power source of the fan is arranged as an extension of the shaft of the fan's impeller. The centrifugal fan can also function with a belt-drive. The outer diameter of the impeller of the centrifugal fan can typically be between 500-1000 mm. The axis of the centrifugal fan conforms to the rotation axis of its impeller. The axis of the centrifugal fan is also preferably equipped with a cooling disc such that an excessive heat transfer along the axis of the fan into the bearing of the motor or the belt roller is prevented.

In a preferred embodiment of the invention, a heating means, such as a steam coil is arranged on the suction side of the centrifugal fan. This heating means can have a similar structure as the heating means used in connection with axial fans of the fan towers in other parts of the air dryer.

As the fans and heating means of the fan tower nearest to the roll tower, i.e. the suction side of the fan tower, are arranged in the first edge of the drying level, then in a very preferred embodiment of the invention the centrifugal fans and the heating means are arranged in the direct vicinity of the roll tower, in the opposing edge of the drying level. The centrifugal fan is thereby then arranged on the opposing side of the drying level compared to the suction and blowing side of the fans of the fan tower adjacent to the roll tower. In this manner there remains more space on the suction side of the fan tower located nearest to the roll tower. In a corresponding manner, the space in the other edge is taken into efficient use.

According to a preferred embodiment of the invention, the amount of air through a centrifugal fan is 5-20 $m^3/s$, preferably 7-10 $m^3/s$, and 3-15, preferably 6-10 of them are arranged mainly on top of each other. The number of centrifugal fans needed depends on the output of the fans and of their physical size. If a projection or extension can be made in the side wall of the protective cover of the air dryer, bigger centrifugal fans can be used, whereby naturally a smaller total number of them are needed. In other case, the side wall of the protective cover is arranged straight, and the centrifugal fans and their dimensioning are adjusted by taking into account the available space. In the arrangement according to the invention, the number of the centrifugal fans can thereby be chosen according to the needs and/or limitations set by the process and the available space. In an embodiment a same number of centrifugal fans are arranged in the end part of the air dryer as there are fans in the fan towers. The centrifugal fans are preferably arranged on top of each other in one row such that they are in the same line.

For the centrifugal fan, an assembly opening of a suitable size can be arranged in the end wall of the protective cover of the air dryer. The centrifugal fan can be fastened for example in a back plate or the like, which is fastened with fastening means, for example with openable bolts, to cover the assembly opening. Then the blowing part and suction part of the centrifugal fan are inside the protective cover of the air dryer. Preferably the centrifugal fan's power source, such as a motor, remains outside the protective cover, which will simplify the maintenance measures, among others. Also in view of sufficient cooling of the motor and bearings of the centrifugal fan, it is preferable that they are located outside the protective cover of the air dryer. The back plate of the centrifugal fan can be detached when needed during the servicing of the fan or the fixing of malfunctions in the process. The centrifugal fan is simple to maintain also because, it being arranged in the direct vicinity of the roll tower, it can be easily reached via a moving maintenance platform typically arranged in the end part of the air dryer. This moving maintenance platform has previously been used mainly for the maintenance and control measures required by the roll tower. One advantage of the present invention is thus the simplified maintenance and reparation of the fans of the air dryer's end part.

An inlet connection is arranged from the blowing side of the centrifugal fan to the drying means arranged between the roll tower and the dryer group of the nearest fan tower. The inlet connection can, in its simplest form, be a pressure chamber, which is open from the blowing side of the centrifugal fan to the air inlet side of the drying means. If there are several drying means, some of the drying means can be arranged to be shorter in their longitudinal direction, whereby the inlet connection can comprise a distributing chamber, which is in connection to the air inlet side of these shorter drying means. It is also possible that, into some of the drying means, side openings or side channels are arranged by means of which the leading of drying air to the adjacent drying means, to its air inlet side, is intensified.

The centrifugal fans arranged in the end of the air dryer, in the direct vicinity of the roll tower, can be grouped into centrifugal fan groups, of which each group comprises a number of centrifugal fans. The number of fans does not have to be equal in each group, but the fans can be freely divided into groups according to need. An end of an air dryer can comprise for example two centrifugal fan groups, of which the first one has 3 and the second one has 4 fans. It is also possible to divide the fans into, for example, three groups, of which each has ⅓ of the total number of fans.

The centrifugal fans, i.e. their amount of air, can be adjusted by using inverter control i.e. rotation speed control, and possibly also the temperature of the blown air can be adjusted. The centrifugal fans can be adjusted one by one or one centrifugal fan group can be adjusted as a whole. This enables a better optimizing of the operability of the air dryer with respect to other process conditions. The centrifugal fans can for example be arranged in fan groups, whose blowing velocities are arranged so as to be independent form each other.

Preferably end parts according to the invention are arranged in both end parts of the air dryer. These arrangements can however differ from each other, what comes e.g. to the number, blowing velocity, etc. of the end drying means between the roll tower and the dryer group of the fan tower located nearest to the roll tower.

According to an embodiment of the invention, with the end drying means arranged between the roll tower and the dryer group of the fan tower, air is blown at the same velocity or at a higher velocity as with the drying means of the dryer group, for example with a blowing velocity of about 20-40 m/s. In an embodiment, the blowing velocity of the end drying means arranged between the roll tower and the dryer group of the fan tower located nearest to the roll tower is considerably higher than the blowing velocity used in other drying means of the air dryer. The blowing velocity can be for example 10-30% higher than the blowing velocity used in the drying means of the last dryer group. With the aid of the blowing velocity used, it is possible to adjust the travel of the web to be dried or to increase the drying capacity of the air dryer.

It is also possible that, on different drying levels of the air dryer, the amount of the end drying means arranged between the roll tower and the dryer group of the fan tower located nearest to the roll tower is variable, i.e. the number of the end drying means does not need to be the same at the same end on each drying level. Thereby, on the first and the second drying levels a different number of end drying means are arranged between the roll tower and the dryer groups of the fans of the nearest fan tower. For example 5 end drying means can be arranged on the first drying level, and 4 end drying means on the second drying level between the last fan tower and the roll tower.

BRIEF DESCRIPTION OF THE FIGURES

The invention is described below in more detail with reference to the enclosed schematic drawing, in which.

DETAILED DESCRIPTION OF THE PREFERRED EMBODIMENTS

Figure 1:
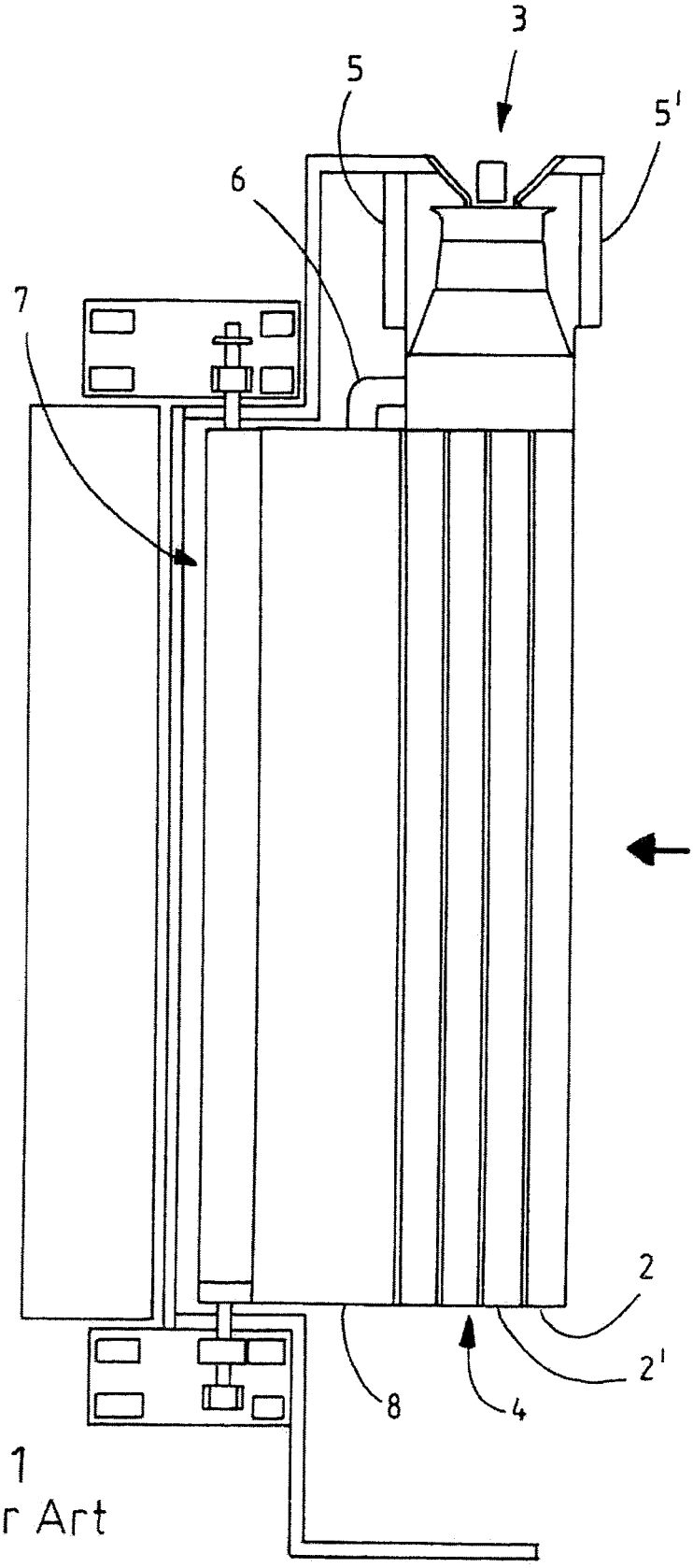
FIG. 1 Prior Art
FIG. 1 shows in a top view a typical end part of an air dryer according to prior art.

FIG. 1 shows in a top view a typical end part of an air dryer according to prior art. The travelling direction of a cellulose web to be dried in an air dryer is marked with an arrow in FIG. 1. The web to be dried is supported and dried with the aid of drying air jets generated by drying means 2, 2'. The nozzle openings or the like of the drying means 2, 2' are not shown in FIG. 1. Drying air is arranged to the drying means 2, 2' with the aid of an axial fan 3 arranged in a fan tower. In the example shown in FIG. 1 an axial fan is arranged to supply air to a dryer group formed by four drying means. Heating means 5, 5' are arranged on the suction sides of the axial fan 3 in order to heat and dry the drying air. An air inlet connection 6 is also conducted from the axial fan 3 in order to supply air to an auxiliary level nozzle 8 arranged in the area between a dryer group 4 and a turn roll 7. It is clear that the blowing capacity generated by the axial fan is not necessarily sufficient in order to satisfy the need for drying air and conveying air of both the dryer group 4 and the auxiliary level nozzle. This leads to an impaired drying result at least in the area of the auxiliary level nozzle 8, possibly also in the area of the dryer group 4.

Figure 2:
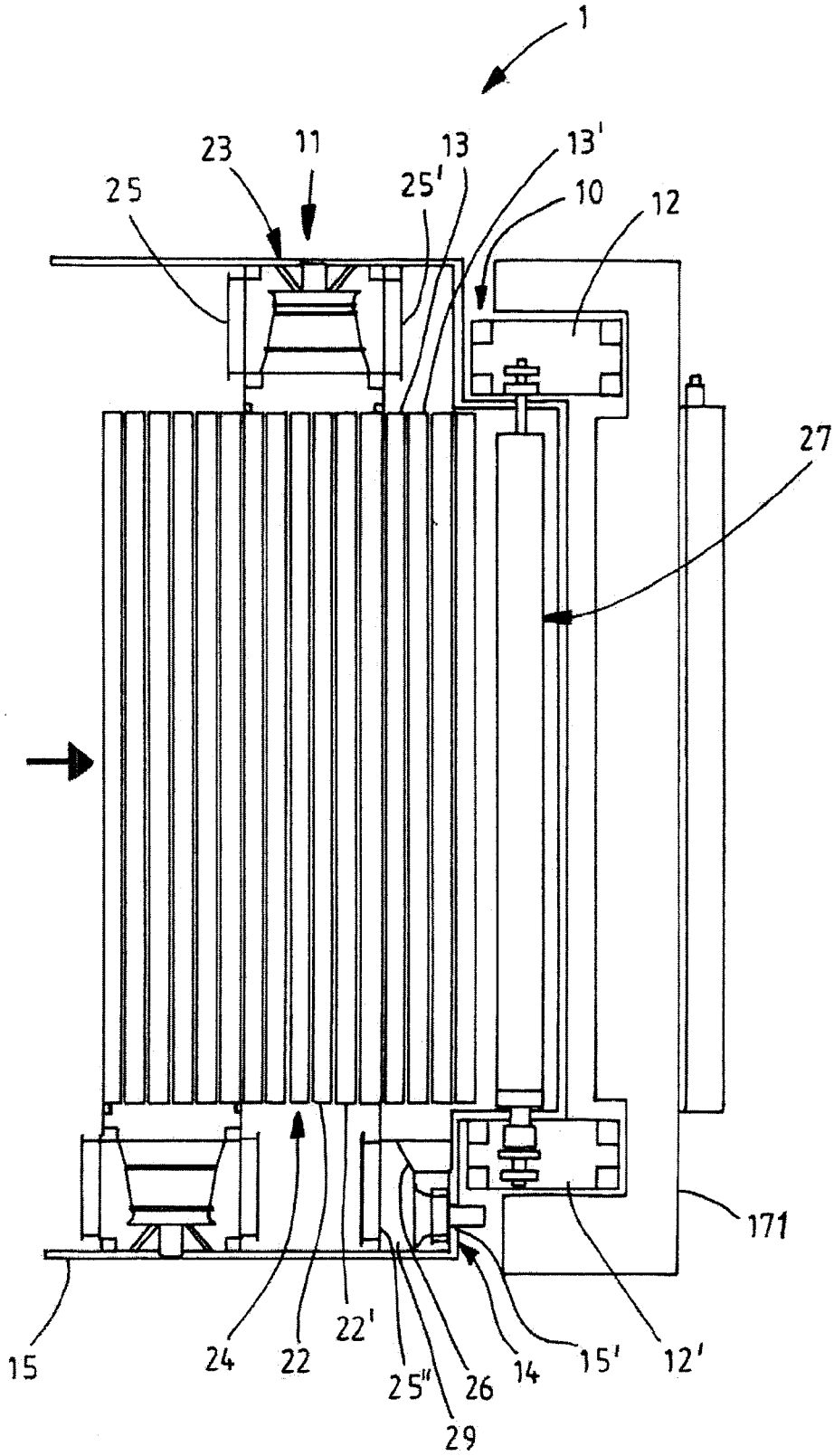
FIG. 2 shows in a top view an end part of an air dryer according to the invention.

FIG. 2 shows in a top view an end part of an air dryer according to the invention. The travelling direction of the web is shown by an arrow in the figure. The end part 1 of an air dryer comprises, according to the invention, a fan tower 11 located nearest to a roll tower 10, and the area between them. A turn roll 27 is arranged in the roll tower 10 in order to change the travelling direction of the web to be dried by 180° in the end of the drying level. The turn roll 27 is arranged by its ends to supporting means 12, 12'. The roll tower naturally comprises a required number of turn rolls arranged on top of each other, which is not, however, seen in FIG. 2. An axial fan 23 is arranged in the fan tower 11 in a known manner, on the suction sides of which axial fan heating means 25, 25' are arranged. The fan tower 11 respectively comprises a number of fans and heating means arranged on top of each other. The fan 23 is arranged to blow air to a dryer group 24, which comprises six drying means 22, 22'. The drying means 22, 22' comprise nozzle slots, nozzle openings or the like, through which drying air is lead towards the web to be dried.

According to the invention, end drying means 13, 13' are arranged in the area between the dryer group 24 of the fan tower 11 and the roll tower. The structure of these end drying means 13, 13' corresponds to the structure of the drying means 22, 22' of the dryer group 24, and said end drying means 13, 13' are arranged on the same level with said drying means 22, 22'. Drying air is arranged to the end drying means 13, 13' with the aid of a centrifugal fan 14. The centrifugal fan 14 is arranged in the direct vicinity of the roll tower, in the end wall 15' of the protective cover 15 of the air dryer. A heating means 25" is arranged on the suction side of the centrifugal fan 14, the structure of the heating means 25" corresponding to the heating means 25, 25' arranged on the suction sides of the fan 23 of the fan tower 11. The centrifugal fan 14 is in connection with the end dying means 13,13' via air inlet assemblies 26, such as for example pressure chambers or the like. The centrifugal fan draws circulation air from the air dryer through the heating means 25" into a suction chamber 29, from which the fan draws air and blows it into the pressure chamber 26, from which the air is led via, for example, distribution channels to the end drying means 13, 13'. The centrifugal fan can be easily reached for maintenance with the aid of a movable maintenance platform 171. The maintenance platform is arranged to travel in a vertical direction alongside the end wall 15' of the protective cover 15 of the air dryer. In the solution shown in FIG. 2, the supporting means 12, 12' of the roll tower 10 are not covered by the protective cover 15 of the air dryer, but can also be so arranged.

Figure 3:
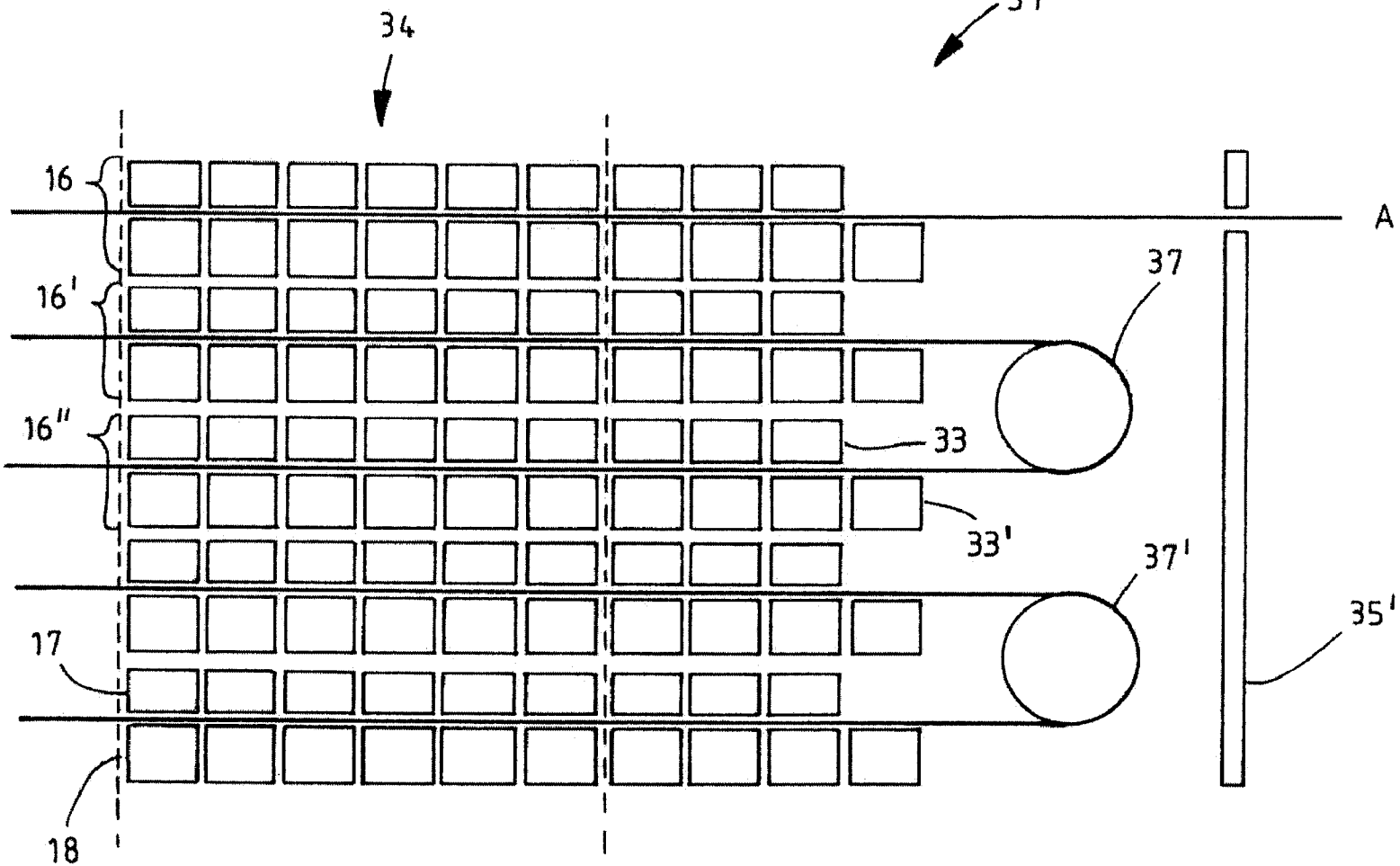
FIG. 3 shows in a side view an end part of an air dryer according to the invention.

FIG. 3 shows an end part of an air dryer according to the invention as seen from the side. FIG. 3 describes the end part 31 of an air dryer by which the web A to be dried is conveyed inside the air dryer. The travelling direction of the web to be dried is turned in the end part of the air dryer with the aid of turn rolls 37, 37'. For the sake of clarity, other structures of the roll tower are not shown in the figure. The dryer group division of the fans of the fan tower adjacent to the roll tower is shown by vertical broken lines in FIG. 3. For the sake of clarity, the fan tower itself, its structures or the axial fans blowing air to the dryer groups are not shown. The web A to be dried is dried on drying levels 16, 16', 16", of which each comprises drying means 17, 18 arranged above and below the web. The upper drying means 17 are in this embodiment different from the lower drying means 18, but they can also be similar. With the aid of axial fans of the fan towers, drying air is arranged both to the upper and the lower drying means.

End drying means 33, 33' are arranged in the area between the turn rolls 37, 37' of the roll tower and the dryer groups 34 of the nearest fan tower, both above and below the web A to be dried. FIG. 3 shows that a different number of end drying means 33' are arranged below the web to be dried than above the web. Thereby the drying capacity of the end part can be intensified in a desired manner, and the control of the web A to be dried can be improved in the end part of the air dryer. The structure of the end drying means arranged above and below the web corresponds to the upper and lower drying means 17, 18 of the dryer group 34. Drying air is arranged to the end drying means 33, 33' with a centrifugal fan, which is not shown in the figure, but which is in principle arranged into the end wall 35' of the protective cover of the air dryer. In FIG. 3 the end drying means of all drying levels 16, 16', 16" are similar and each drying level has an equal number of upper and lower end drying means. It is clear that the number of the end drying means both above and below the web to be dried can vary from one drying level to another, depending on the drying capacity desired for a drying level or on other aspects related to the drying process.

Only one advantageous embodiment of the invention is shown in the figures. Facts of secondary importance regarding the main idea of the invention, facts known as such or evident to a person skilled in the art, such as power sources or support structures possibly required by the invention, are not separately shown in the figures. It is evident to a person skilled in the art that the invention is not limited exclusively to the examples described above, but that it can vary within the scope of the claims presented below. The dependent claims present some possible embodiments of the invention, and they are not to be considered to restrict the scope of protection of the invention as such.

What is claimed is:

1. An end part (1) of an air dryer, the air dryer being applicable for drying a pulp web the end part comprising a roll tower (10) comprising a number of turn rolls (27, 37) arranged substantially on top of each other, the longitudinal axis of the turn rolls being parallel, in order to turn the travelling direction of the pulp web in the end part of the air dryer, a fan tower (11) arranged at a distance from the roll tower, adjacent to it, comprising a plurality of fans (23) arranged on top of each other, each fan of the plurality of fans being arranged to blow heated air as drying air to a dryer group (24), at least one centrifugal fan (14) arranged in a direct vicinity of the roll tower, and a plurality of end drying means (13) arranged between the roll tower (10) and the said dryer group (24) of the said individual fan of the fan tower (11), to which end drying means drying air is fed with the at least one centrifugal fan.

2. The end part (1) according to claim 1, wherein a heating device is arranged on a suction side of the at least one centrifugal fan (14).

3. The end part (1) according to claim 1, wherein the plurality of end drying means comprises 3-6, end drying means (13) arranged between the roll tower (10) and the drying means (22) of the dryer group (24) of the fan tower (11).

4. The end part according to claim 3, wherein the plurality of end drying means comprises 4-5 end drying means (13).

5. The end part (1) according to claim 1, wherein the plural end drying means (13) arranged between the roll tower (10) and the dryer group (24) of the fan tower (11) are arranged in the same level with the drying means (22) of the dryer group below the travelling path of the web to be dried.

6. The end part (1) according to claim 1, wherein the end drying means (13) are arranged between the roll tower (10) and the dryer group (24) of the fan tower (11) above the travelling path of the web to be dried.

7. The end part (1) according to claim 1, wherein an amount of air through each of the at least one centrifugal fan (14) is 5-20 $m^3/s$ and the at least one centrifugal fan comprises 3-15 centrifugal fans arranged substantially on top of each other.

8. The end part according to claim 7, wherein an amount of air through the centrifugal fan 14 is 7-10 $m^3/s$.

9. The end part according to claim 8, wherein the at least one centrifugal fan comprises 6-10 centrifugal fans.

10. The end part according to claim 7, wherein the at least one centrifugal fan comprises 6-10 centrifugal fans.

11. The end part (1) according to claim 1, wherein the end drying means (13) arranged between the roll tower (10) and the dryer group (24) of the fan tower (11) are substantially similar to the drying means (22) of the dryer group (24).

12. The end part (1) according to claim 1, wherein the at least one centrifugal fan (14) is a plug fan.

13. The end part according to claim 1, wherein the pulp web to be dried is a cellulose web.

14. A method for drying a pulp web in an end part (1) of an air dryer, the method comprising turning a travelling direction of the pulp web to be dried in the end part with the aid of a turn roll (27, 37) arranged in a roll tower (10), blowing heated drying air towards the pulp web in order to dry it with drying means (22) of a dryer group (24), the drying air is arranged to the dryer group by a fan (23), which is arranged in a fan tower (11) arranged at a distance from the roll tower (10), arranging at least one centrifugal fan (14) in the direct vicinity of the roll tower (10), and arranging a number of end drying means (13) between the roll tower (10) and the said dryer group (24) of the fan of the fan tower (11), and feeding drying air to end drying means (13) using the at least one centrifugal fan (14).

15. The method according to claim 14, wherein the end drying means (13) arranged between the roll tower (10) and the dryer group (24) of the fan tower (11), blows air at the same velocity as or at a higher velocity than the drying means (22) of the dryer group (24).

16. The method according to claim 14, end drying means arranged above the travelling path of the web blow drying air between the roll tower (10) and the dryer group (24) of the fan tower (11).

17. The method according to claim 14, further comprising controlling the amount of air through the at least one centrifugal fan (14) using a rotation speed control.

18. An air dryer, which is applicable for drying a pulp web, comprising a plurality of drying levels (16), wherein a single drying level (16) of the plural drying levels comprises a number of dryer groups (24), which comprise a number of adjacent drying means (22) in order to dry and to support the web to be dried, a plurality of adjacent fan towers (11), each comprising a plurality of fans (23) arranged on top of each other, an individual fan being arranged to blow heated air as drying air to one dryer group (24) of one of the drying level, a plurality of heating devices (25) fitted on the suction sides of the fans of the fan towers in order to reheat the humid air discharged from the dryer section, a first and a second end part (1), each comprising a roll tower (10) and an adjacent one of the fan towers (11) arranged at a distance from the roll tower (10) and the dryer groups (24) to which the fan tower (11) is arranged to supply drying air, the drying levels (16), fan towers (11) and heating devices (25) being arranged between the first and the second end parts (1), at least one of the first and/or the second end part of the air dryer comprises at least one centrifugal fan (14) arranged in a direct vicinity of the roll tower, and a plurality of end drying means (13) arranged between the roll tower (10) and the said dryer group (24) of the said individual fan of the fan tower (11), to which end drying means drying air is fed with the at least one centrifugal fan.

19. The air dryer according to claim 18, wherein on the first and the second drying levels (16) a different number of end drying means (33, 33') are arranged between the roll tower (10) and the dryer groups (24) of the fans of the nearest fan tower (11).

20. The air dryer according to claim 18 wherein the centrifugal fans (14) are arranged in fan groups whose blow velocities are arranged so as to be independent from each other.

21. The air dryer according to claim 18, wherein the end drying means (13) of the at least one of the end parts arranged between the roll tower (10) and the dryer groups (24) of the fan tower (11) are arranged to blow air at the same velocity as or at a higher velocity than the dryer groups (24) of the drying levels.

22. The air dryer according to claim 18, wherein the at least one centrifugal fan (14) is a plug fan arranged in the end wall (35) of the air dryer.

23. A method of drying a pulp web using a centrifugal fan in an air dryer comprising:

arranging the centrifugal fan to feed air into an end drying means between a roll tower and a dryer group; and feeding air to the end drying means (13) arranged between the roll tower (10) and the dryer group (24) of a fan tower (11).

* * * * *